US006729690B2

(12) United States Patent
Roleder et al.

(10) Patent No.: US 6,729,690 B2
(45) Date of Patent: May 4, 2004

(54) COMPACT FOLDABLE MASSAGE CHAIR

(75) Inventors: Jon W. Roleder, La Jolla, CA (US); William A. Martin, Carlsbad, CA (US); Paul M. G. Weiskopf, La Mesa, CA (US); Arthur John Drusch, III, Escondido, CA (US)

(73) Assignee: Earthlite Massage Tables Inc., Vista, CA (US)

( * ) Notice: Subject to any disclaimer, the term of this patent is extended or adjusted under 35 U.S.C. 154(b) by 172 days.

(21) Appl. No.: 09/731,037

(22) Filed: Dec. 5, 2000

(65) Prior Publication Data

US 2002/0101108 A1 Aug. 1, 2002

(51) Int. Cl.[7] ..... A47C 7/50
(52) U.S. Cl. ..... 297/423.12; 297/16.1
(58) Field of Search ..... 297/423.11, 423.12, 297/16.2, 55, 16.1, 19, 22, 24, 25, 27, 46, 47, 48, 51

(56) References Cited

U.S. PATENT DOCUMENTS

| | | | | |
|---|---|---|---|---|
| 4,258,951 | A | * | 3/1981 | Groom |
| 4,290,643 | A | * | 9/1981 | Logan, 3rd. |
| 4,650,249 | A | * | 3/1987 | Serber |
| 4,746,167 | A | | 5/1988 | Palmer et al. |
| 4,832,407 | A | | 5/1989 | Serber |
| 5,177,823 | A | | 1/1993 | Riach |
| D334,982 | S | | 4/1993 | Riach |
| 5,295,728 | A | * | 3/1994 | Schaevitz |
| 5,401,078 | A | | 3/1995 | Riach |
| 5,460,430 | A | * | 10/1995 | Miga, Jr. et al. |
| 5,487,590 | A | * | 1/1996 | Haynes |
| D369,691 | S | | 5/1996 | Haynes |
| 5,542,746 | A | | 8/1996 | Bujaryn |
| 5,582,464 | A | | 12/1996 | Maymon |
| 5,667,278 | A | | 9/1997 | Li |
| 5,720,517 | A | * | 2/1998 | Prothro, Sr. ..... 297/423.12 X |
| 5,762,402 | A | | 6/1998 | Gillotti |
| 5,813,727 | A | | 9/1998 | Sugawa et al. |
| 5,921,696 | A | | 7/1999 | Gillotti |
| 5,943,965 | A | | 8/1999 | Riach et al. |
| 5,971,485 | A | | 10/1999 | Clark |
| 6,065,808 | A | | 5/2000 | Tinsley |
| 6,174,028 | B1 | * | 1/2001 | Yang et al. |
| 6,186,593 | B1 | * | 2/2001 | Garneau ..... 297/188.01 |
| 6,273,865 | B1 | | 8/2001 | Perez |

* cited by examiner

*Primary Examiner*—Peter R. Brown
*Assistant Examiner*—Stephen Vu
(74) *Attorney, Agent, or Firm*—James P. Broder; Steven G. Roeder

(57) ABSTRACT

A massage chair (10) is provided. The massage chair (10) includes (i) a front lower support (12) including a front attachment section (14), (ii) a rear lower support (16) including a rear attachment section (18), (iii) a seat (48) secured to the rear lower support (12), (iv) a front upper support (22) including an upper attachment section (24), (v) a chest rest (26) secured to the front upper support (22), and (vi) a connector (28). Importantly, the connector (28) connects the front attachment section (14), the rear attachment section (18) and the upper attachment section (24) and allows for relative motion of the front lower support (12), the rear lower support (16) and the front upper support (22) about the connector (28). As a result of this design, the massage chair (10) easily moves between a transport position (32) and an upright position (30). Further, as a result of this design, the profile of the massage chair (10) in the transport position (32) is relatively small.

45 Claims, 9 Drawing Sheets

COMPACT FOLDABLE MASSAGE CHAIR

FIELD OF THE INVENTION

The present invention is directed to massage chairs. More specifically, the present invention is directed to a massage chair that is lightweight, compact and foldable.

BACKGROUND

As the benefits of therapeutic massage are becoming more widely appreciated, more and more people are participating in therapeutic massage. In order to fulfill this need, massage chairs have been developed that are transportable to the location of the client or to a mutually convenient location. The massage chair allows the patient to be resting in an upright position while receiving a massage.

Existing massage chairs are movable between a folded, transport position and an unfolded, upright position. Unfortunately, existing massage chairs are somewhat heavy and bulky when in the transport position and are relatively difficult to move between the transport position and the upright position. Thus, existing massage chairs can be relatively difficult for a person to carry and set up.

In light of the above, there is the need for a massage chair that is relatively lightweight and strong. Additionally, there is a need for a massage chair that is relatively compact when in the transport position. Moreover, there is a need for a massage chair that moves relatively easily between the transport position and the upright position.

SUMMARY

The present invention is directed to a massage chair that satisfies these needs. The massage chair includes (i) a front lower support including a front attachment section, (ii) a rear lower support including a rear attachment section, (iii) a seat secured to one of the lower supports, (iv) a front upper support including an upper attachment section, (v) a chest rest secured to the front upper support, and (vi) a connector. Importantly, the connector connects the front attachment section, the rear attachment section and the upper attachment section and allows for relative motion of the front lower support, the rear lower support and the front upper support. As a result of this design, the massage chair easily moves between a folded transport position and an unfolded, upright position. Further, as a result of this design, the overall dimensions of the massage chair, in the transport position are relatively small.

Preferably, the connector includes a locking mechanism that selectively inhibits relative motion between the front upper support and at least one of the lower supports. The locking mechanism can include an upper support disk assembly that is secured to the front upper support, a lower support disk assembly that is secured to one of the lower supports, and a tightener that is used to pull the upper support disk assembly against the lower support disk assembly. As provided herein, the upper support disk assembly can include a plurality of upper support disks that are secured to the front upper support and the lower support disk assembly can include a plurality of lower support disks that are secured to one of the lower supports. When urged together, the disks inhibit relative motion between the front upper support and at least one of the lower supports.

Preferably, the seat moves relative to the rear lower support between the transport position and the upright position. More specifically, in one version, a flip brace secures the seat to the rear lower support. As provided herein, rotation of the flip brace in a first rotational direction allows the seat to move from the upright position towards the transport position and rotation of the flip brace in a second rotational direction allows the seat to move from the transport position towards the upright position. As a result of this design, the seat easily moves between the transport position and the upright position.

One or more of the supports is preferably made of a material that is cast into the shape of the support, extruded into the shape of the support or injection molded into the shape of the support. With this design, more material can be placed in areas of the support that require additional strength and stiffness and less material can be placed in the areas of the support that require less strength and stiffness. Further, one or more of the supports can include an I shaped cross-section having a thickness that is varied along the support. The I shape inhibits twisting of the support and provides excellent resistance to nicks and dents. As a result of this design, the massage chair can be precisely manufactured to be both lightweight and strong.

Further, at least one and preferably both of the lower supports includes a lateral support. The lateral support inhibits the massage chair from tipping. Additionally, the massage chair includes a face rest and an armrest that are secured to the front upper support, and a knee pad that is secured to the rear lower support.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
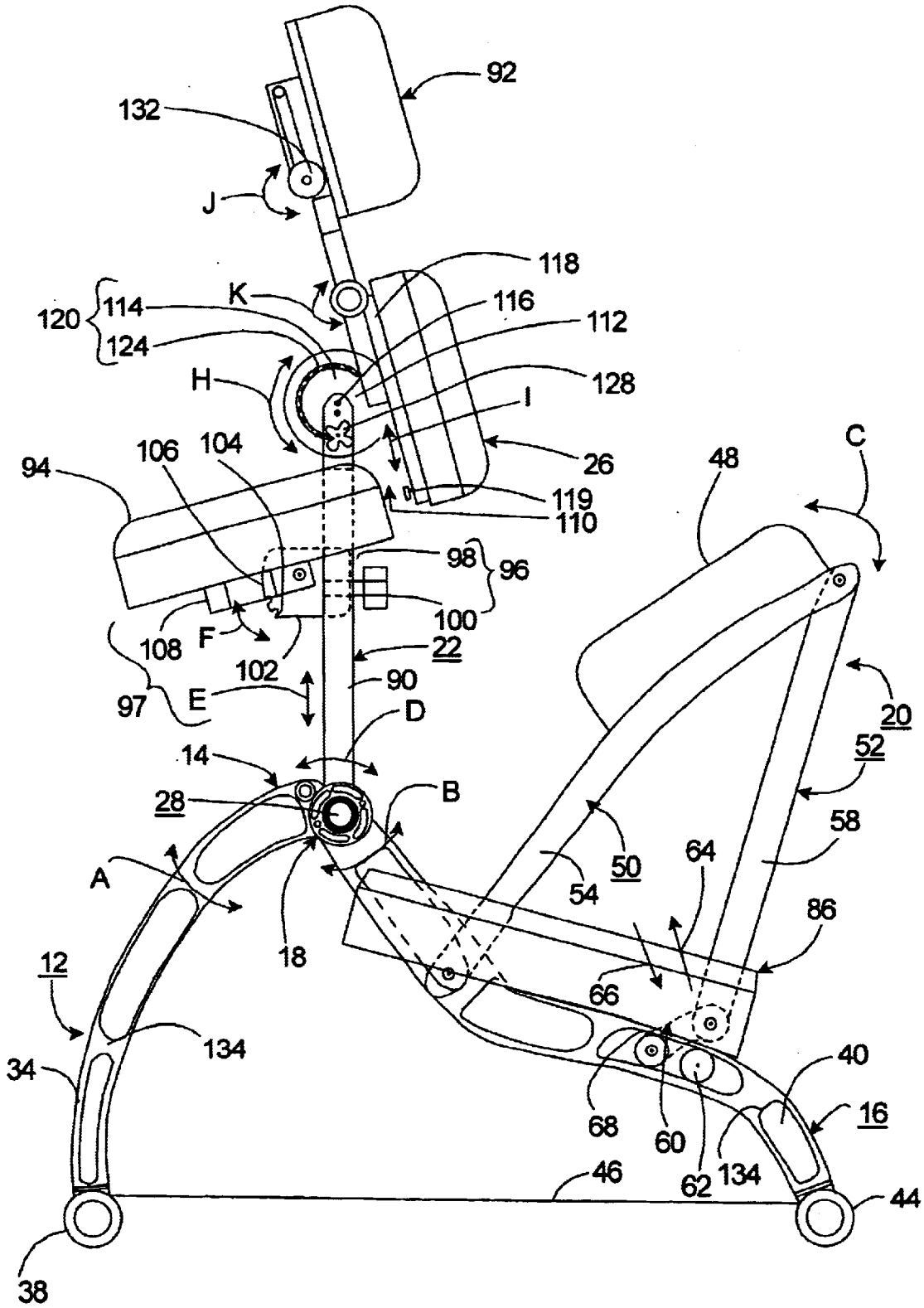
FIG. 1 is a side elevational view of a massage chair having features of the present invention, with the chair in an upright position.
Figure 2:
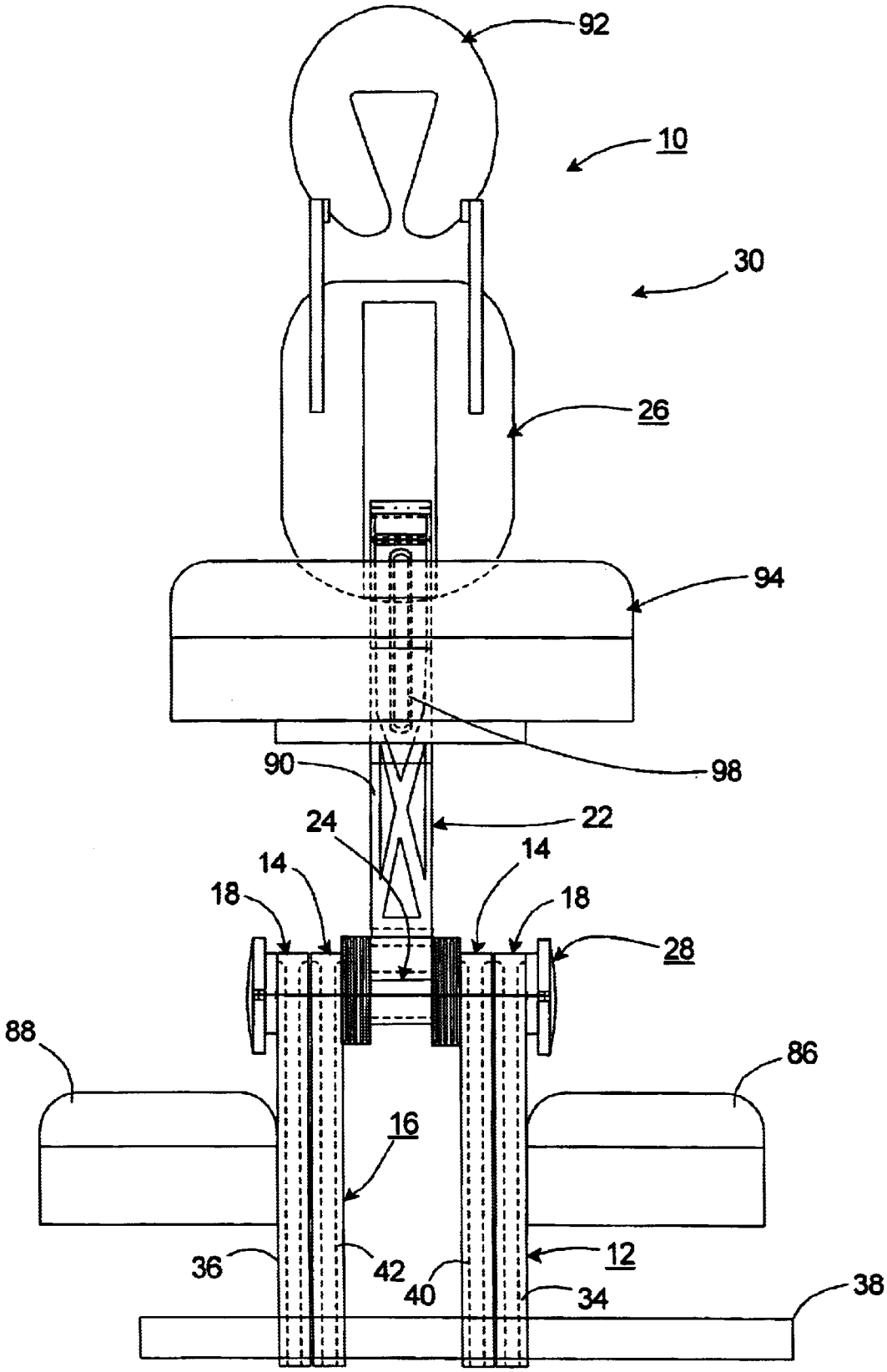
FIG. 2 is a front elevational view of the chair of FIG. 1.
Figure 3:
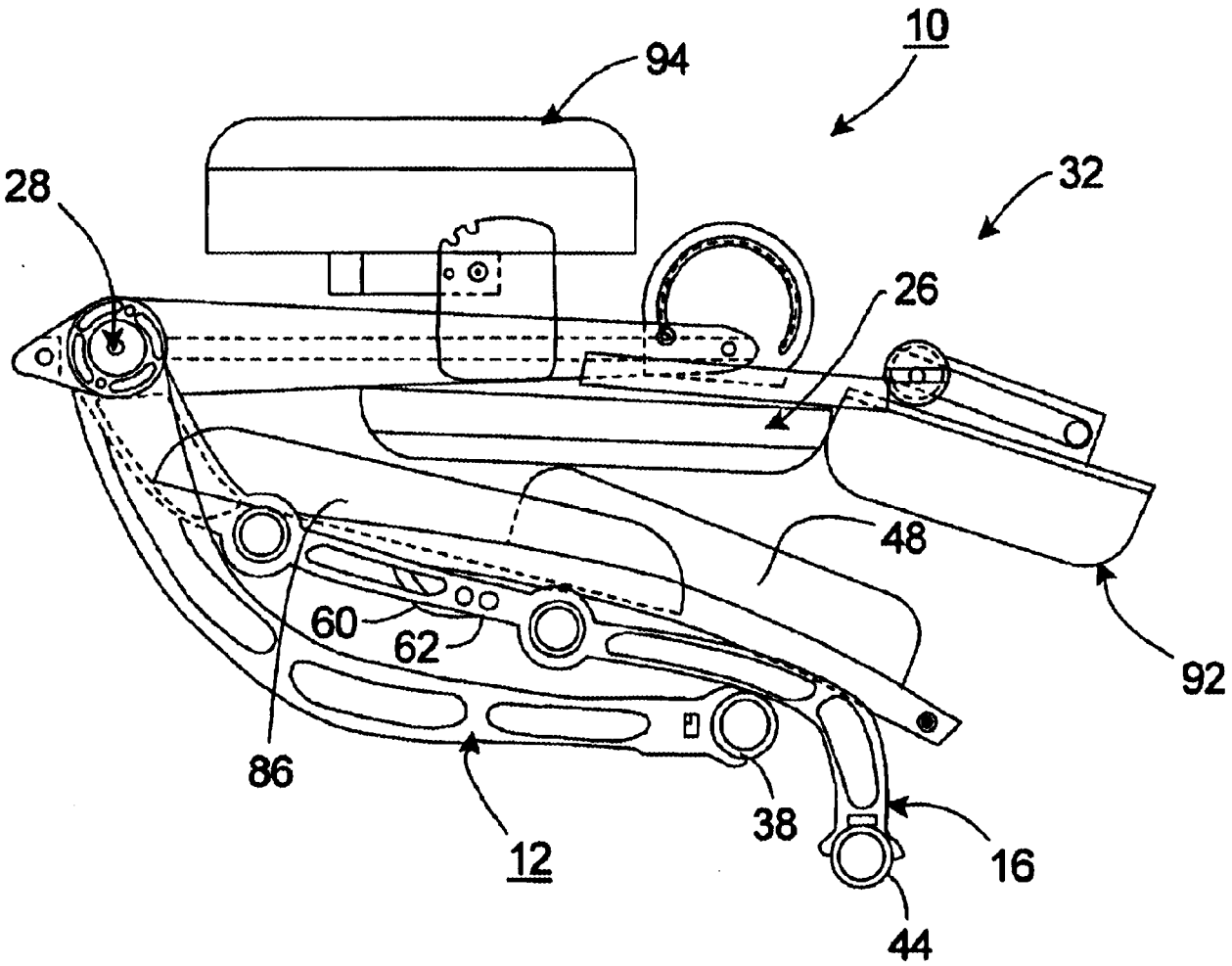
FIG. 3 is a side elevational view of the chair of FIG. 1, with the chair in a folded, transport position.

Referring initially to FIGS. 1–3, the present invention is directed to a massage chair 10 that includes (i) a front lower support 12 having a front attachment section 14, (ii) a rear lower support 16 having a rear attachment section 18, (iii) a seat assembly 20, (iv) a front upper support 22 having an upper attachment section 24, (v) a chest rest 26, and (vi) a connector 28. Importantly, the connector 28 connects the front attachment section 14, the rear attachment section 18 and the upper attachment section 24 and allows for relative motion of the front lower support 12, the rear lower support 16 and the front upper support 22.

As a result of the design provided herein, the massage chair 10 easily moves between an unfolded, upright position 30 (illustrated in FIGS. 1 and 2) and a folded transport position 32 (illustrated in FIG. 3). Further, as a result of this design, the overall dimensions of the massage chair 10, in the transport position 32 are relatively small. Additionally, the chair 10 is preferably less than 25 pounds in weight. Moreover, the dimensions of the chair 10 in the transport position 32 are preferably less than 19 inches by 29 inches by 20 inches. The resulting chair 10 is relatively easy to transport.

The design of the front lower support 12 can be varied to suit the design requirements of the message chair 10. In the embodiment illustrated in the Figures, the front lower support 12 includes a right front strut 34 and a left front strut 36 (illustrated in FIG. 2). In the embodiment illustrated in the Figures, a tubular shaped opening in each front strut 34, 36 defines the front attachment section 14. Each of the front struts 34, 36 is somewhat curved shaped and extends between the connector 28 and the ground. Further, in this embodiment, the front struts 34, 36 are substantially parallel. Alternately, for example, the front lower support 12 can include more than two front struts or less than two front struts. Arrow designated A illustrates the rotation of the front lower support 12 about the connector 28.

Preferably, the front lower support 12 includes a laterally extending front lateral support 38. In this embodiment, the front lateral support 38 inhibits tipping of the massage chair 10 and provides lateral stability to the chair 10. Further, the front lateral support 38 connects the front struts 34, 36 together and causes the front struts 34, 36 to pivot concurrently about the connector 28.

The front lateral support 38 is preferably a round tube, made from a high strength and lightweight material, such as aluminum. However, a square tube or some other material could be used as well, such as steel or wood, so long as sufficient lateral stability to the chair 10 is provided. Also, preferably, the ends of the front lateral support 38 are finished for cosmetic purposes and also to prevent injury. Further, rotatable wheels (not shown) can be attached to the front lateral support 38 to allow for ease of movement of the chair 10. Alternately, the front lateral support 38 can be integrally formed and integrated into the front lower support 12.

The design of the rear lower support 16 can be varied to suit the design requirements of the message chair 10. In the embodiment illustrated in the Figures, the rear lower support 16 includes a right rear strut 40 and a left rear strut 42 (illustrated in FIG. 2). In the embodiment illustrated in the Figures, a tubular shaped opening in each rear strut 40, 42 defines the rear attachment section 18. Each of the rear struts 40, 42 is complex curve shaped and extends rearwardly between the connector 28 and the ground. Further, in this embodiment, the rear struts 40, 42 are substantially parallel. Alternately, for example, the rear lower support 16 can include more than two rear struts or less than two rear struts. Arrow designated B illustrates the rotation of the rear lower support 16 relative to the connector 28.

Preferably, the rear lower support 16 includes a laterally extending rear lateral support 44. In this embodiment, the rear lateral support 44 inhibits tipping of the massage chair 10 and provides lateral stability to the chair 10. Further, the rear lateral support 44 connects the rear struts 40, 42 together and causes the rear struts 40, 42 to pivot concurrently about the connector 28.

The rear lateral support 44 is preferably a round tube, made from a high strength and lightweight material, such as aluminum. However, a square tube or some other material could be used as well, such as steel or wood, so long as sufficient lateral stability to the chair is provided. Also, preferably, the ends of the rear lateral support 44 are finished for cosmetic purposes and also to prevent injury. Further, rotatable wheels (not shown) can be attached to the rear lateral support 44 to allow for ease of movement of the chair 10. Alternately, the rear lateral support 44 can be integrally formed and integrated into the rear lower support 16.

Preferably, referring to FIG. 1, the massage chair 10 includes a flexible support 46 that extends between the front lower support 12 and the rear lower support 16. In the embodiment illustrated in FIG. 1, the flexible support 26 extends from near the front lateral support 38 to near the rear lateral support 44. In one embodiment, the flexible support 46 maintains the front lower support 12 from rotating farther away from the rear lower support 14 after the chair 10 is setup. Additionally, depending upon the design of the connector 28, the flexible support 46 can act as a safety catch in the event of failure or accidental incomplete engagement of connector 28. A suitable flexible support 46 can be a flexible cable.

The seat assembly 20 is secured to the rear lower support 16 and allows for a patient to comfortably sit on the massage chair 10. Preferably, at least a portion of the seat assembly 20 moves relative to the rear lower support 16 during movement of the massage chair 10 between the transport position 32 and the upright position 30. In the embodiment illustrated in the Figures, the seat assembly 20 includes a seat 48, a forward seat support 50, and a rearward seat support 52. In this embodiment, the seat assembly 20 is movable between the upright position 30 and the transport position 32 so that the chair 10 has a relatively small profile in the transport position 32. Alternately, however, the seat assembly 20 could be designed so that the seat is fixedly secured to the rear lower support 16.

The seat 48 is preferably made of a resilient pad, covered with cloth or any other cosmetically suitable and durable material. Alternatively, for example, the seat 48 may be made by blow mold technology and covered with cloth or other such material.

The design of the forward seat support 50 can be varied to suit the design requirements of the message chair 10. In the embodiment illustrated in the Figures, the forward seat support 50 includes a right forward frame 54 and a left forward frame (not shown). In the embodiment illustrated in the Figures, each of the forward frames 54 is a slightly curved beam. The forward frames 54 are preferably substantially parallel. The right forward frame 54 includes a proximal end that is pivotably secured to the right rear strut 40 and a distal end that extends slightly past the seat 48. Somewhat similarly, left forward frame includes a proximal end that is pivotably secured to the left rear strut 42 and a distal end that extends slightly past the seat 48. Alternately, for example, the forward seat support 50 can include more than two forward frames or less than two forward frames.

The seat 48 is secured across the forward frames 54, 56 near the distal end of each forward frame 54. As a result of this design, the seat 48 and the forward frames 54 cantilever and pivot relative to the rear lower support 16. Arrow designated C illustrated the pivoting of the seat 48.

The design of the rearward seat support 52 can be varied to suit the design requirements of the message chair 10. In the embodiment illustrated in the Figures, the rearward seat support 52 includes a rearward frame 58, a flip latch 60 and a latch stop 62. Importantly, as described below, as a result of this unique design, rotation and/or movement of the flip latch 60 in a first rotational direction 64 allows the seat assembly 20 to easy move from the upright position 30 to the transport position 32. Alternately, rotation and/or movement of the flip latch 60 in an opposite, second rotational direction 66 allows the seat assembly 20 to easy move from the transport position 32 to the upright position 30. This feature greatly simplifies the folding and unfolding of the chair 10.

In the embodiment illustrated in the FIG. 1, the rearward frame 58 is a substantially straight beam. Alternately, in the embodiment illustrated in FIG. 6, the rearward frame 58 is curved. The rearward frame 58 includes a distal end that is pivotable secured to the forward frames 54 between the distal ends of the forward frames 54. The rearward frame 58 also includes a proximal end that is pivotable secured to a distal end of the flip latch 60. This design allows for relative movement and pivoting between (i) the rearward frame 58 and the forward frames 54 and (ii) the rearward frame 58 and the flip latch 60. Alternately, for example, the rearward seat support 52 can include more than one rearward frames.

The design of the flip latch 60 can be varied to suit the design requirements of the message chair 10. In the embodiment illustrated in FIG. 1, the flip latch 60 includes a right flip brace 68 and a spaced apart left flip brace (not shown). In the embodiment illustrated in FIG. 1, each of the flip braces 68 is a beam that is slightly arched shaped. The flip braces 68 are preferably substantially parallel. The right flip brace 68 includes a proximal end that is pivotably secured to the right rear strut 40 and a distal end that is pivotable secured to the rearward frame 58. Somewhat similarly, left flip brace includes a proximal end that is pivotably secured to the left rear strut 42 and a distal end that is pivotable secured to the rearward frame 58 opposite from the right flip brace 68. Stated another way, the proximal end of the rearward frame 58 is pivotable secured between the distal ends of the flip braces 68. This design allows for relative movement and pivoting between (i) the flip latch 60 and the rearward frame 58, and (ii) the flip latch 60 and the rear lower support 16. Alternately, for example, in the embodiment illustrated in FIG. 6, the flip latch 60 includes only one flip brace 68.

The latch stop 62 inhibits the flip latch 60 from rotating too far in the second rotational direction 66. The design of the latch stop 62 can be varied. In the embodiment illustrated in FIG. 1, the latch stop 62 is a rod that is fixedly attached to and extends between the rear struts 40, 42. In this design, the flip latch 60 contacts the latch stop 62 to inhibit over rotation of the flip latch 60. In the embodiment illustrated in FIG. 1, the flip latch 60 contacts the latch stop 62 near the distal end of the flip latch 60. Stated another way, when the seat 48 is placed in a position for receiving an individual, the flip latch 60 is placed in a locked position by resting against the latch stop 62.

It should be noted that the forward seat support 50, the rearward seat support 52, the flip latch 60 and a portion of the rear lower support 16 cooperate to function as a four bar linkage assembly. With this design, with the seat 48 in the upright position 30, rotation of the flip latch 60 in the first rotational direction 64 (counterclockwise in FIG. 1) causes (i) the forward seat support 50 to initially move upward and rotate in one direction (counterclockwise in FIG. 1) relative to the rear lower support 16 and subsequently move downward and rotate in the opposite direction (clockwise in FIG. 1) relative to the rear lower support 16, (ii) the rearward seat support 52 to initially move upward and rotate in one direction (clockwise in FIG. 1) towards the forward seat support 50 and subsequently move downward toward the rear lower support 16 and continue to rotate in the same direction (clockwise in FIG. 1) towards the forward seat support 50. It should be noted that the components of the seat assembly 20 are preferably designed so that in the transport position 32, the forward seat support 50, the rearward frame 58, a portion of the rear lower support 16, and the flip latch 60 are folded together and approach an approximately parallel configuration. This minimizes the profile of the seat assembly 20 in the transport position 32.

Alternately, with the seat 48 in the transport position 32, rotation of the flip latch 60 in the second rotational direction 66 (clockwise in FIG. 1) causes (i) the forward seat support 50 to initially move upward and rotate in one direction (counterclockwise in FIG. 1) relative to the rear lower support 16 and subsequently move downward and rotate in the opposite direction (clockwise in FIG. 1) relative to the rear lower support 16, (ii) the rearward seat support 52 to initially move upward and rotate in one direction (counterclockwise in FIG. 1) relative to the forward seat support 50 away from the forward seat support 50 and subsequently move downward toward the rear lower support 16 and continue to rotate in the same direction (counterclockwise in FIG. 1) away from the forward seat support 50. The flip latch 60 continues to rotate until it engages the latch stop 62. It should be noted that the flip latch 60 and the rearward seat support 52 form an obtuse angle when the seat 48 is in the upright position 30.

In summary, rotation and/or movement of the flip latch 60 in the first rotational direction 64 allows the seat assembly 20 to easy move from the upright position 30 to the transport position 32. Alternately, rotation and/or movement of the flip latch 60 in the opposite, second rotational direction 66 allows the seat assembly 20 to easily move from the transport position 32 to the upright position 30. This feature greatly simplifies the folding and unfolding of the chair 10.

Preferably, the position and/or height of the seat 40 in the upright position 30 can be adjusted to suit the individual user. It is contemplated that the position of the seat 48 can be adjusted at least approximately 10 degrees or more. The position and/or height of the seat 40 can be adjusted in a number of ways. For example, referring to FIG. 4, the latch stop 62 can include one or more alternately sized cams 72. Each of the cams 72 has a distal surface 74. The distance between a central axis 76 of the latch stop 62 and the distal surface 74 varies between the different cams 72. The latch stop 62 can be rotated about the central axis 76 relative to the rear lower support 16. In this design, the position of the seat 40 is varied according to which portion of the latch stop 62 engages the flip latch 60. Stated another way, the user rotates the latch stop 62 until the desired cam 72 is positioned to engage the flip latch 60.

Figure 5:
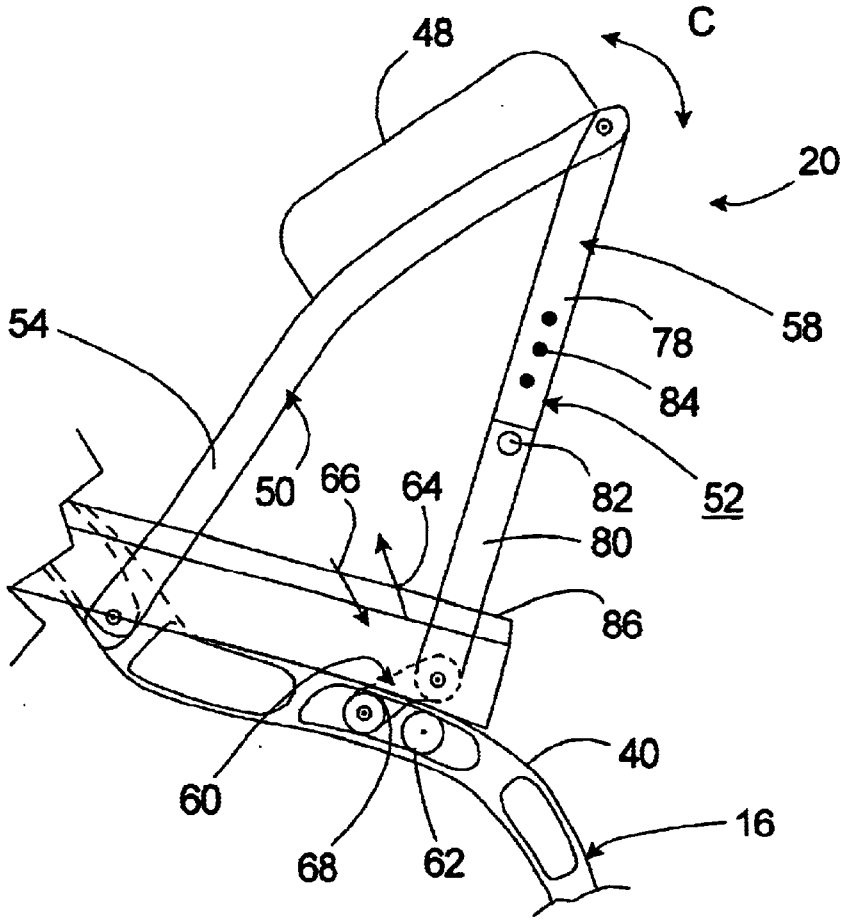
FIG. 5 is a side view of another embodiment of a seat assembly having features of the present invention.

Alternately, for example, referring to FIG. 5, the rearward frame 58 could be designed to provide adjustment in the position of the seat 48. In this design, the rearward frame includes an upper beam 78, a lower beam 80 and an adjustment pin 82. In this embodiment, the position of the upper beam 78 relative to the lower beam 80 is adjusted to either lengthen or shorten the rearward frame 58. More specifically, a portion of the upper beam 78 fits within a cavity (not shown) in the lower beam 80. The upper beam 78 includes a plurality of pairs of upper beam apertures 84 and the lower beam 80 includes a pair of lower beam apertures (not shown). In use, the user selects the position of the seat 48 by first removing the adjustment pin 82 from the apertures in the upper beam 78 and the lower beam 80. Next, the seat 48 is lifted or lowered to the desired position and the adjustment pin 82 is reinserted into the appropriate apertures in the beams 78, 80.

Still alternately, the height of the seat can be adjusted by any number of various devices or mechanisms suitable for moving the seat 48 higher or lower and fixing it in position to support and accommodate individuals of alternate size and weight. For example, an electric motor could be used to accomplish raising or lowering of the seat 48.

Preferably, the massage chair 10 includes a right knee pad 86 and a left knee pad 88 for supporting the front of the legs of the individual from the knee to the ankle. The left knee pad 88 and right knee pad 86 can be made of a resilient material, such as foam, and covered with a suitably cosmetic and durable material. In a preferred embodiment, the left knee pad 88 and the right knee pad 86 have a generally horizontal attitude. In the embodiment illustrated in the Figures, the left knee pad 88 is fixedly attached to left rear strut 42 and the right knee pad 86 is attached to right rear strut 40. In this embodiment, the left knee pad 88 and the right knee pad 86 are approximately parallel to one another. Alternately, for example, if the rear lower support 16 includes only one rear strut, the left knee pad 30 and right knee pad 31 can cantilever away from alternate sides of the single rear strut.

The design of the front upper support 22 can be varied to suit the design requirements of the message chair 10. In the embodiment illustrated in the Figures, the front upper support 22 includes a single upper strut 90 that includes the upper attachment section 24. In the embodiment illustrated in the Figures, the upper attachment section 24 is a tubular shaped opening in the upper strut 90. The upper strut 90 is somewhat straight and extends generally upwardly and vertically from the connector 28. However, the desired orientation of the front upper support 22 may be varied to suit the user. In this embodiment, the upper strut 90 is positioned between the front struts 34, 36 and between the rear struts 40, 42. Alternately, for example, the front upper support 22 can include more than one upper strut. Arrow designated D illustrates the rotation of the front upper support 22.

Preferably, the chair 10 includes a face rest 92 and an arm rest 94 that are adjustably secured to the front upper support 22. The face rest 92 is adapted for receiving the face and an arm rest 94 is adapted for supporting the arms of an individual sitting in the chair 10.

In the embodiment illustrated in the Figures, the arm rest 94 extends in a forward direction away from the front upper support 22. The arm rest 94 can be made of a resilient pad, such as foam or other suitable soft material with a covering of natural or synthetic fabric. An arm rest linear adjustment 96 provides linear position adjustment of the arm rest 94 relative to the front upper support 22, as illustrated by arrow "E" in FIG. 1, and an arm rest angle adjustment 96 for attitude adjustment as illustrated by arrow "F" in FIG. 1. This provides for necessary articulation of arm rest 94 to accommodate arm length size and position for proper support of the individual during massage.

Figure 4:
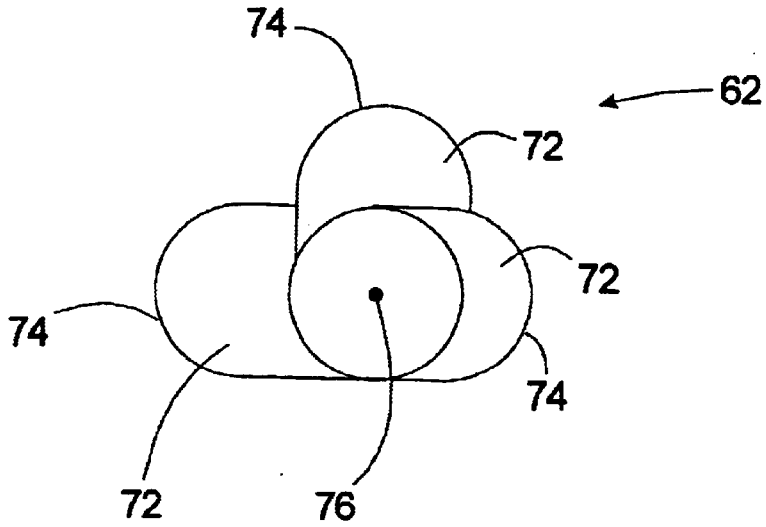
FIG. 4 is an end view of a latch stop having features of the present invention.

Arm rest linear adjustment 96 includes a slot 98 in the front upper support 22 and a knob 100 having a screw slidably engaged with slot 98 and threaded into bracket 102. Bracket 102 is therefore able to slide along the front upper support 22 and be tightened at a selected position by knob 100. Bracket 102 includes slots 104 positioned on opposite sides of bracket 102, for engagement by tongs 106 (one on each side) that are moved, or actuated, by pull handle 108. This handle is preferably spring loaded (with the spring hidden from view) to urge tongs 106 into opposing slots for locking arm rest 94 at a selected angle. Arm rest 94 is also rotatable so as to be approximately parallel and adjacent to the front upper support 22 when the chair 10 is folded in the transport position 32, as shown in FIG. 4.

The chest rest 26 can be a resilient pad that is secured to the front upper support 22 at an upper end thereof. The chest rest 26 faces rearwardly in a position for resting the chest of the individual. Preferably, a chest rest height adjustment 110 provides vertical adjustment of chest rest 26. As illustrated in FIG. 1, the adjustment 110 can include a base plate 112 fixed to a pair of spaced apart wing plates 114. Wing plates 114 are pivotally mounted to the upper end of the front upper support 22 by pivot rod 116. The chest rest 26 includes a C-shaped channel 118. For linear adjustment "I" of the chest rest 26, channel 118 is slidably engaged with the base plate 112 and is locked into at any desired position with knob 119.

Angular adjustment of chest rest 26 is provided by a chest rest angular adjustment 120 providing rotation about pivot rod 116. Angular adjustment can be accomplished by using circular slots 124 in wing plates 114 centered on pivot rod 116 and locking knob 128 for locking the chest rest 26 at any angular position over a range of approximately 180 angular degrees. Linear position adjustment is illustrated by arrow "I", and angular adjustment by arrow "h" in FIG. 1. Thus, necessary articulation of chest rest 26 is provided to accommodate trunk length size and position on the apparatus to afford comfort and proper support of the individual during massage.

Additionally, a sternum pad may be removably disposed on chest rest 26 to provide additional comfort and support, especially for women. Chest rest 26 is also rotatable so as to be approximately parallel and adjacent to front upper support 22 when the chair 10 is folded in the transport position 32, as illustrated in FIG. 3.

The face rest 92 can be made of a resilient pad that is split as shown in FIG. 2 for comfortably accepting a face. The face rest 92 is attached to the chest rest 26 and extends in a generally upward direction therefrom in a position for resting the face of an individual. Although it is understood that face rest 92 is designed to engage the face of an individual seated in the chair 10, it also supports the head and neck of the individual. The face rest 92 is preferably mounted on an articulating adjustable strut 132 as illustrated in FIG. 1. In a preferred embodiment, the articulating adjustable strut 132 also provides for angular rotation of face rest 92 so as to accomplish rotation shown by letter "j" in FIG. 1 and for positioning of the face rest 92 with respect to the chest rest 26 as shown by letter "k" in FIG. 1. Motions "j" and "k" are accomplished through the use of couple-joints that are well known to those skilled in the art. These joints are able to readily position the rods attached to them in any one of a plurality of set angular positions. Therefore, the face rest 92 may be adjusted proximally and angularly with respect to the chest rest 26 as shown in FIG. 1 and folded as shown in FIG. 3.

Figure 6:
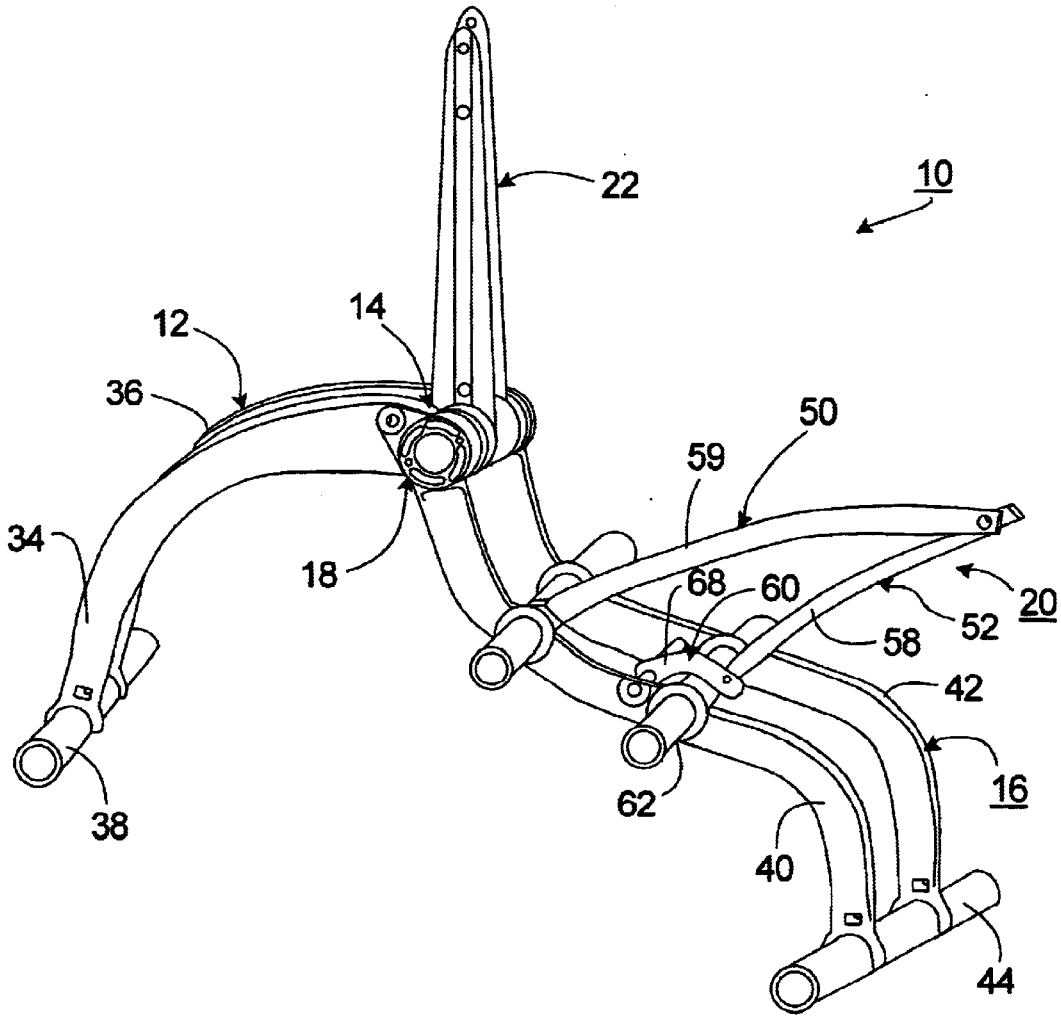
FIG. 6 is a perspective view of a portion of a massage chair having features of the present invention.

FIG. 6 illustrates a perspective view of a portion of another embodiment of a massage chair 10. This embodiment is very similar to the embodiment illustrated in FIG. 1.

However, in this embodiment, the front attachment section 14 and the rear attachment section 18 are positioned slightly higher. Thus, with this design, the connector (not shown in FIG. 6) is also positioned higher. As a result thereof, the front upper support 22 can be easily adjusted while the customer is seated in the massage chair 10 and the customer is less likely to hit the connector with their knee when the customer is positioned in the massage chair 10.

Figure 7A:
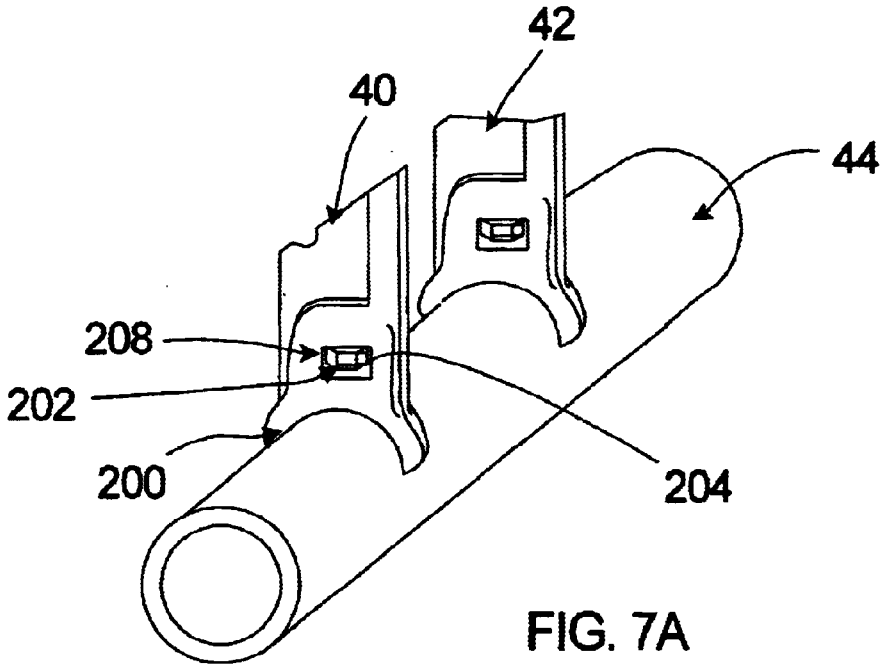
FIG. 7A is a perspective view of a portion of a massage chair.
Figure 7B:
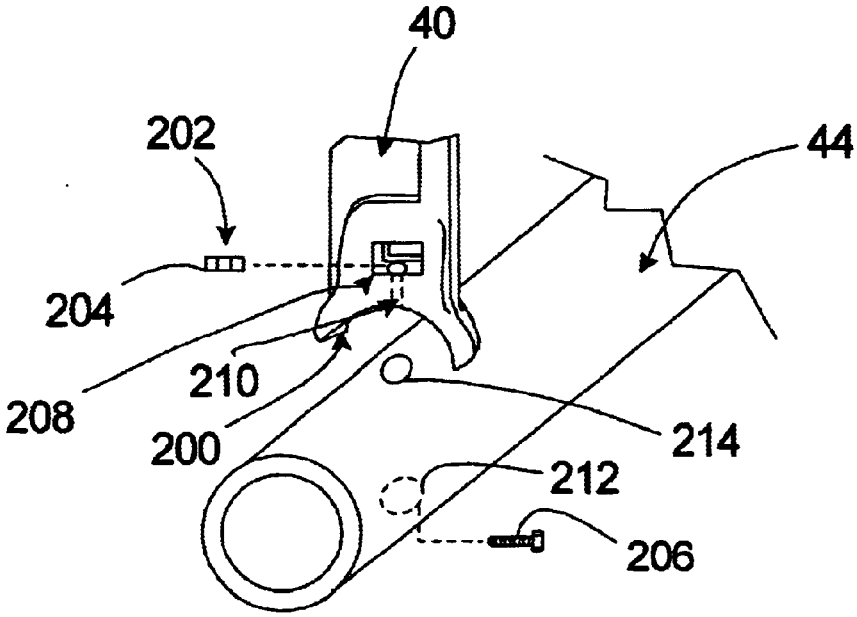
FIG. 7B is an exploded perspective view of the portion of the massage chair of FIG. 7A.

FIGS. 7A and 7B illustrates one embodiment of how the rear lateral support 44 can be secured to the rear struts 40, 42. It should be understood that the front lateral support 38 can be secured to the front struts 34, 36 in a similar fashion. In this embodiment, a bottom of each rear strut 40, 42 includes a semi-circular shaped channel 200 that fits around a portion of the tubular shaped, lateral support 44. Further, one or more fasteners 202 are used to secure each rear strut 40, 42 to the lateral support 38. Each fastener 202 includes a first component 204 and a second component 206. In this embodiment, the first component 204 is nut while the second component 206 is a bolt. In this embodiment, the distal end of each rear strut 40, 42 includes a rectangular shaped fastener aperture 208 that receives the first component 204 and inhibits the first component 204 from rotating. Further, the distal end of each strut 40, 42, includes a strut aperture 210 that allows the second component 206 to extend into the fastener aperture 208. Moreover, for each strut 40, 42, the lateral support 38 includes a lower aperture 212 and an upper aperture 214. The lower aperture 212 is sized and shaped to allow the entire second component 206 (the entire bolt) to pass through. Further, the upper aperture 214 is sized and shaped to allow only a portion of the second component 206 to pass through. In this embodiment, both the head and body of the bolt pass through the lower aperture 212 while the body and not the head passes through the upper aperture 214.

As provided herein, one or more of the supports 12, 16, 22 are made of a material that is cast into the shape of the respective support 12, 16, 22. Further, the material is preferably relatively lightweight and strong such as aluminum. The cast aluminum provides a significant amount of strength while minimizing the overall weight of the chair. Alternately, one or more of the supports 12, 16, 22 can be made from an extruded material or one or more of the supports 12, 16, 22 can be made by injection molding.

Figure 8A:
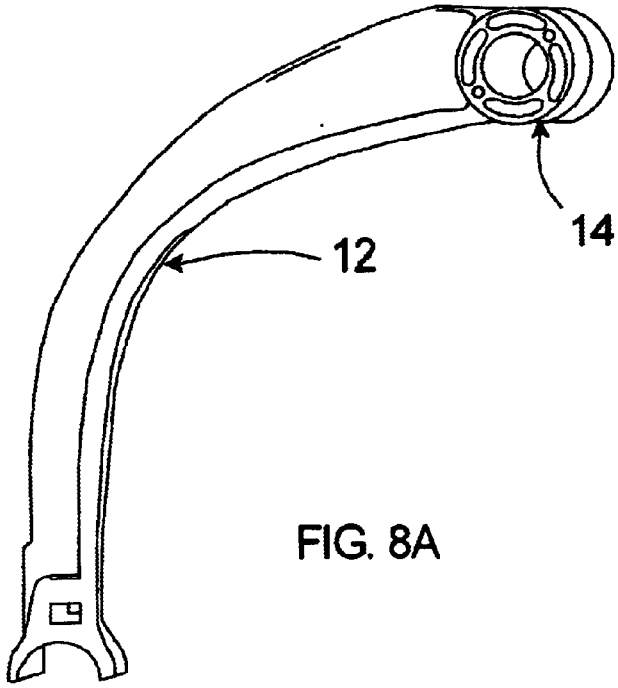
FIG. 8A is a perspective view of a front strut having features of the present invention.
Figure 8B:
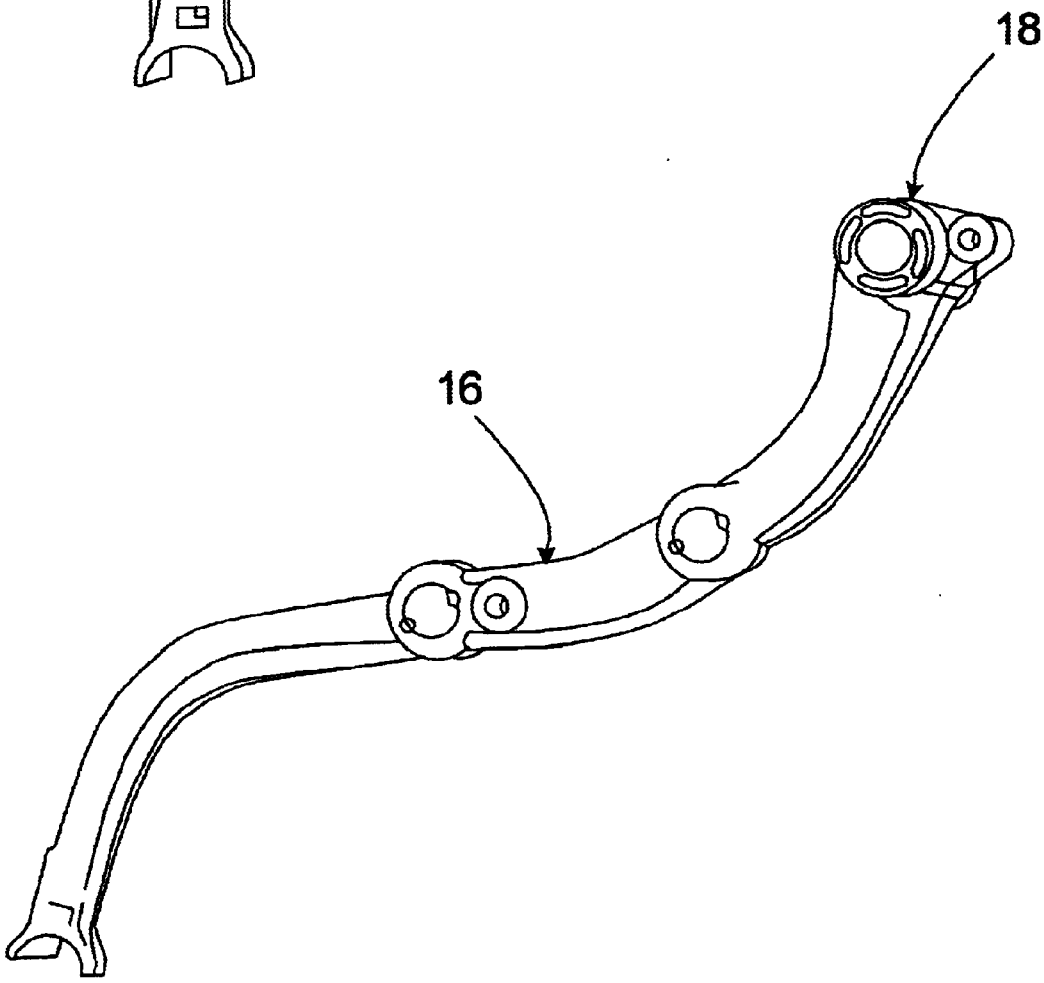
FIG. 8B is a perspective view of a rear strut having features of the present invention.

FIG. 8A illustrates a perspective view of a right front strut 34 and FIG. 8B illustrates a right rear strut 40. Uniquely, because these struts 34, 40 are made from a casting, from a mold or by injection molding, more material can be placed in specific areas of the struts 34, 40 that require additional strength and stiffness and less material can be placed in the areas of the strut that require less strength and stiffness. Stated another way, the thickness and/or the cross-sectional area of the strut 34, 40 can be easily varied according to the strength requirements.

In the embodiment illustrated in FIG. 1, each of the struts 34, 40 has a generally "I" shaped cross-section and a plurality of generally rectangular shaped nodes 134. This shape reduces twisting of the struts 34, 40 and provides excellent resistance to nicks and dents. It should be noted that thickness of the struts 34, 40 is varied along each strut 34, 40. More specifically, the cross-sectional thickness of each of the struts 34, 40 increases towards the respective attachment section 14, 18. Further, it should be noted that the nodes 134 are positioned in high stress areas such as bends and curves and in horizontally extending areas of the respective struts 34, 40.

With this design, more material is placed in areas of the support 12, 16 that require additional strength and stiffness and less material is placed in the areas of the support 12, 16 that require less strength and stiffness. As a result of this design, the massage chair 10 can be precisely manufactured to be both lightweight and strong. This feature allows the present chair 10 to support a person weighing 350 pounds, or more. The relatively lightweight also allow the chair 10 to be transported in a backpack or by a shoulder strap.

Alternately, for example, one or more of the supports 12, 16, 22 could be made from a tube. Still alternately, other suitable material that provides strength could be used, such as wood, steel, aluminum tubing, or the like. However, cast aluminum is especially preferred because of it achieves a high strength-to-weight ratio.

The connector 28 allows the front upper support 22, the front lower support 12 and the rear lower support 16 to rotate relative to each other. Stated another way, the connector 28 allows (i) the front upper support 22 and the front lower support 12 to rotate relative to each other, (ii) the front upper support 22 and the rear lower support 16 to rotate relative to each other, and (iii) the front lower support 12 and the rear lower support 16 to rotate relative to each other. This allows the chair 10 to easily fold into a relatively compact size when in the transport position 32. The design and features of the connector 28 can be varied. For example, referring to FIG. 9, the connector 28 can include a connector guide 150 and a locking mechanism 152.

Preferably, the connector guide 150 allows for relative rotation of the front upper support 22, the front lower support 12 and the rear lower support 16 about a common axis 154. Stated another way, the connector guide 150 allows the structural members of the chair 10 to be joined at one common point and provides strength to the chair 10. This allows the chair 10 to achieve a compact design. Further, the one common joint greatly simplifies the folding and unfolding of the chair 10 because the main structural components of the chair 10 are all accessible from the one common joint. In the embodiment illustrated in the Figures, the connector guide 150 is a tube that extends transversely through (i) the front attachment section 14 of the front lower support 12, (ii) the rear attachment section 18 of the rear lower support 16, and (iii) the upper attachment section 24 of the front upper support 22.

The locking mechanism 152 selectively inhibits relative motion between the front upper support 22 and at least one of the lower supports 12, 16. As provided herein, the locking mechanism 152 can selectively inhibit relative motion between the front upper support 22, the front lower support 12 and the rear lower support 16. The design of the locking mechanism 152 can be varied. In the embodiment illustrated in the Figures, the locking mechanism 152 acts somewhat similar to a clutch and includes an upper support disk set 156, a lower support disk set 158 and a tightener 160.

Figure 10A:
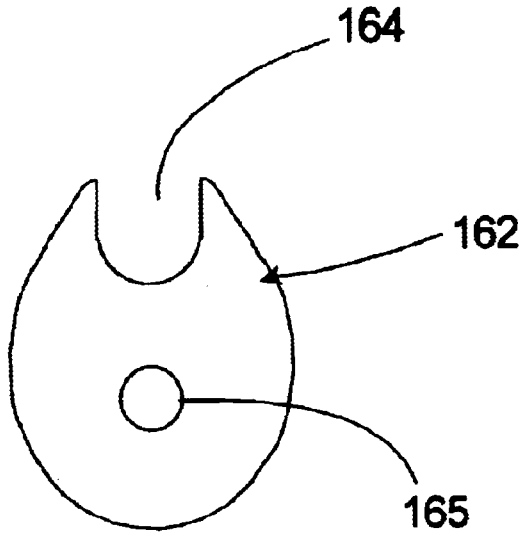
FIG. 10A is a side view of an upper support disk having features of the present invention.

The upper support disk set 156 rotates with the front upper support 22. The upper support disk set 156 includes one or more upper support disks 162. The design and number of upper support disks 162 can be varied. FIG. 10A illustrates a side view of an upper support disk 162. In this embodiment, the upper support disk 162 is generally a circular shape with one elongated end, which contains an upper disk notch 164. Each upper support disk 162 also includes an aperture 165 that allows the upper support disk 162 to fit over the connector guide 150 and rotate relative to the connector guide 150. The front upper support 22 includes a pin 166 that fits within each upper disk notch 164. The pin 166 allows the upper support disks 162 to move transversely relative to the pin 166 but inhibits rotation of the upper support disks 162 relative to the front upper support 22. However, it is contemplated that the upper support disk 162 could be any other shape that also provides a sufficient surface area and has means for inhibiting rotation of the upper support disks 162 relative to the front upper support 22.

In the embodiment illustrated in the Figures, the upper support disk set 156 includes ten upper support disks 162. Alternately, however, the upper support disk set 156 may include more than ten or less than ten disks. For example, the upper support disk set 156 could include a single upper support disk, four upper support disks, twenty upper support disks or any number in between. The design and number of upper support disks 162 is determined by the desired ease of operation and strength of the locking mechanism 152. Generally speaking, the strength of the locking mechanism 152 increases as the contacting surface area of the upper support disks increases. Further, one or more of the upper support disks can include teeth.

Figure 10B:
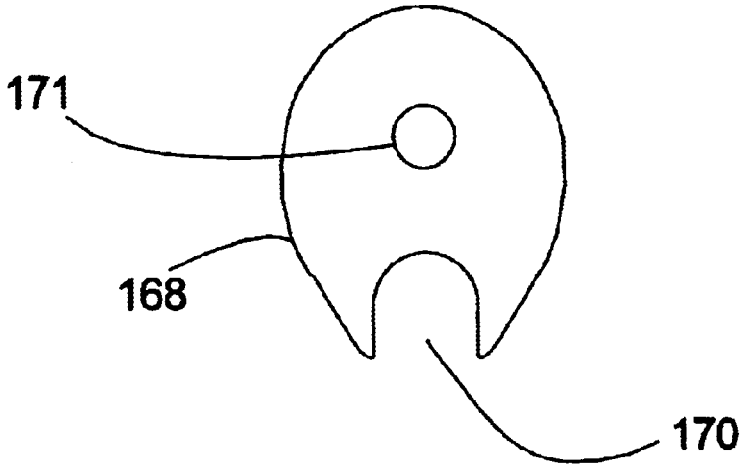
FIG. 10B is a side view of a lower support disk having features of the present invention.

The lower support disk set 158 is secured to one or both of the lower supports 12, 16. The lower support disk set 158 includes one or more lower support disks 168. The design and number of the lower support disks 168 can be varied. In the embodiment illustrated in FIG. 10B, the lower support disk 168 is generally a circular shape with one elongated end, which contains a lower disk notch 170. Each lower support disk 168 also includes an aperture 171 that allows the lower support disk 168 to fit over the connector guide 150 and rotate relative to the connector guide 150. In the embodiment illustrated in the Figures, the front lower support 12 includes a pin 172 that fits within each lower disk notch 170. The pin 172 allows the lower support disks 168 to move transversely relative to the pin 172 but inhibits rotation of the lower support disks 168 relative to the front lower upper support 12. However, it is contemplated that the lower support disk 162 could be any other shape that also provides a sufficient surface area and has means for inhibiting rotation of the disks relative to the front lower support 12.

Further, in the embodiment illustrated in the Figures, the lower support disk set 158 includes ten lower support disks 168. Alternately, however, the lower support disk set 158 may include more than ten or less than ten disks. For example, the lower support disk set 158 could include a single lower support disk, four lower support disks, twenty lower support disks or any number in between. The design and number of the lower support disks 168 is determined by the desired ease of operation and strength of the locking mechanism 152. Generally speaking, the strength of the locking mechanism 152 increases as the contacting surface area of the lower disks increases.

Figure 9:
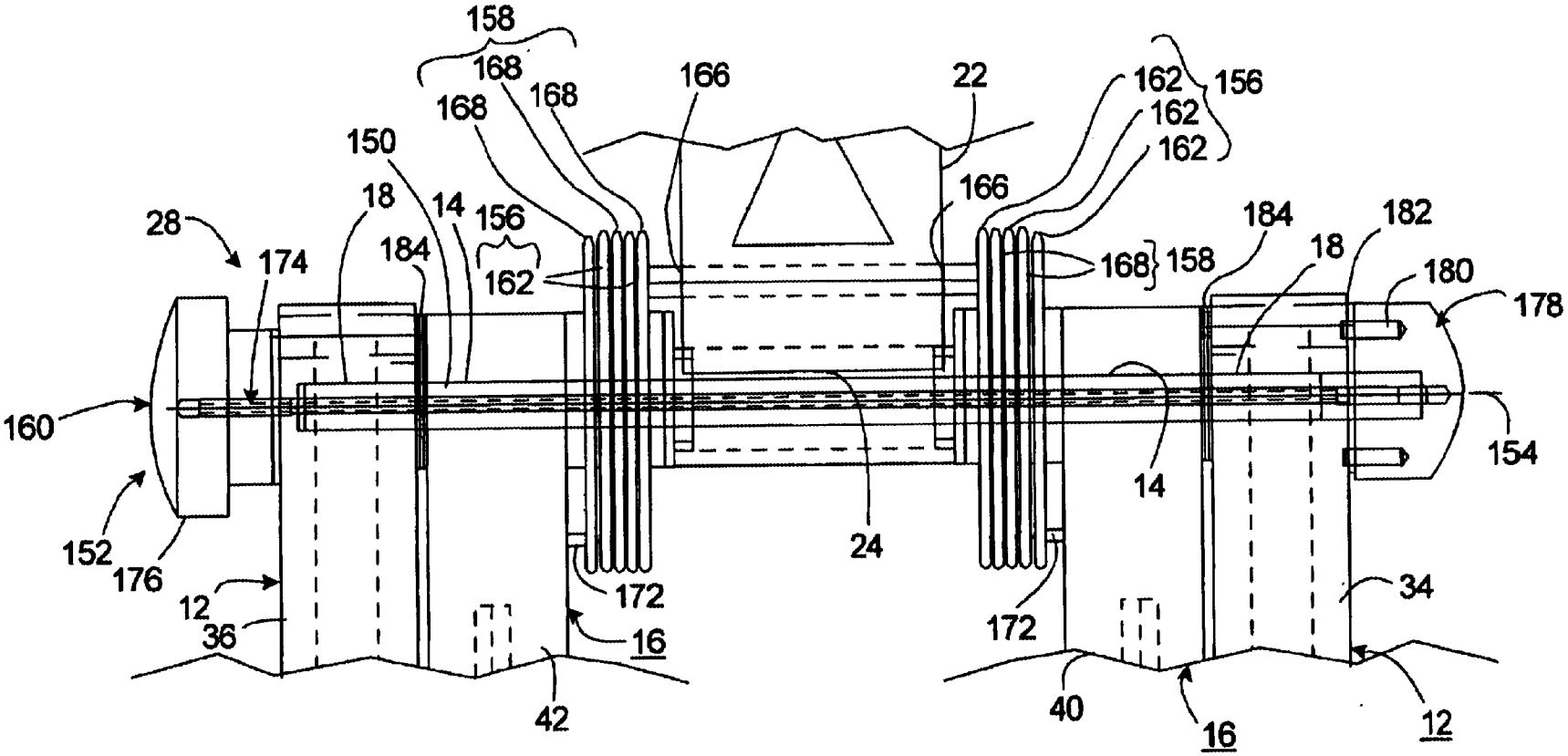
FIG. 9 is a front elevational view of a connector and a portion of the chair.

Referring to FIG. 9, it should be noted that upper support disks 162 and the lower support disks 168 are alternately positioned along the connector guide 150. As a result thereof, each upper support disk 162 is adjacent to at least one of the lower support disks 168. Further, two upper support disks 162 and three lower support disks 168 are positioned on the left of the front upper support 22 and three upper support disks 162 and two lower support disks 168 are positioned on the right of the front upper support 22. The disks are oriented so that the upper disk notches 164 are positioned upwardly and the lower disk notches 170 are positioned downwardly.

The tightener 160 is used to selectively pull the upper support disks 162 against the lower support disks 168. The design of the tightener 160 can be varied. In the embodiment illustrated in the Figures, the tightener 160 includes (i) a threaded rod 174 that extends through the connector guide 150, (ii) a knob 176 that engages the threads of the rod 174, and (iii) a rotation inhibitor 178.

In use, in an unlocked or disengaged position, the knob 176 is barely threaded onto the rod 174 and the supports 12, 16, 22 and disks 162, 168 are free to rotate. This allows the user to collapse or fold the chair 10 into the transport position 32 and/or move the chair 10 from the transport position 32 to the upright position 30. Subsequently, the knob 176 can be rotation to force the supports 12, 16, 22 and the disks 162, 168 together. In a preferred embodiment only ½ turn of knob 176 is required to move the tightener 160 from fully unlocked or disengaged to fully locked or engaged. Importantly, the tightener 160 is used to secure the components of the chair 10 in both the upright position 30 and the transport position 32.

As shown in FIG. 9, the knob 176 is on the right side from the perspective of an individual sitting in the chair 10. This orientation is typically preferred by a right handed individual. However, the knob 176 and rod 174 can be removed and moved to so that the knob 176 is on the left side from the perspective of an individual sitting in the chair, for operation by a left-handed person. The connector guide 150 inhibits the chair 10 from coming apart during this movement.

The rotation inhibitor 178 inhibits rotation of the rod 174 during movement of the knob 176. In the embodiment illustrated in the Figures, the rotation inhibitor 178 pins 180 are secured to the threaded rod 174 opposite from the knob 176. The rotation inhibitor 178 is attached by protruding retaining bolts 180, which are threaded into holes 182 in the front lower support 12.

Additionally, the connector 28 can include washers 184 positioned between the right front strut 34 and the right rear strut 40 and between the left front strut 36 and the left rear strut 42.

With the design illustrated in the Figures, a torque of 90 ft/lbs is easily achieved by ½ turn of knob 176 by an average individual. As such, locking mechanism 152 achieves a high level of strength with minimal effort of the user.

In summary, in one embodiment, the locking mechanism 152 selectively locks one end of the front lower support 12, one end of the rear lower support 16, and one end of the front upper support 22 to inhibit relative rotation. In this design, the locking mechanism 152 provided herein allows the relative positions of the lower support 12, the rear lower support 16, and the front upper support 22 to be fixed at almost any angle. Alternately, in another embodiment, the locking mechanism 152 selectively locks one end of the rear lower support 16 and one end of the front upper support 22 and the flexible support 46 inhibits rotation between the lower supports 12, 16 when the chair 10 is in the upright position 30.

Still alternately, the locking mechanism can be another type of device or mechanism that engages and disengages two or more working parts.

While the particular massage chair 10 as shown and disclosed herein is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A massage chair comprising:

a front lower support including a front attachment section;

a rear lower support that is secured to the front lower support, the rear lower support including a rear attachment section;

a front upper support secured to the lower supports, the front upper support including an upper attachment section;

a chest rest secured to one of the supports;

a seat secured to the rear lower support, the seat being movable relative to the rear lower support between a transport position and an upright position;

a flip brace that secures the seat to the rear lower support, wherein rotation of the flip brace in a first rotational direction allows the seat to move from the upright position towards the transport position; and a connector that connects the front attachment section, the rear attachment section and the upper attachment section, the connector allowing for relative motion of the front lower support, the rear lower support and the front upper support, the connector including a locking mechanism that selectively inhibits relative motion between the front upper support and at least one of the lower supports, the locking mechanism including an upper support disk assembly that is secured to the front upper support, a lower support disk assembly that is secured to one of the lower supports, and a tightener that is used to urge the upper support disk assembly against the lower support disk assembly.

2. A massage chair comprising:

a front lower support including a front attachment section;

a rear lower support secured to the front lower support, the rear lower support including a rear attachment section;

a front upper support secured to the lower support, the front upper support including an upper attachment section;

a chest rest secured to the upper support; and a connector that connects the front attachment section, the rear attachment section and the upper attachment section, the connector allowing for relative motion of the front lower support, the rear lower support and the front upper support about the connector, the connector including a locking mechanism that selectively inhibits relative motion between the front upper support and at least one of the lower supports, the locking mechanism including an upper support disk assembly that is secured to the front upper support, a lower support disk assembly that is secured to one of the lower supports, and a tightener that is used to urge the upper support disk assembly against the lower support disk assembly.

3. A massage chair comprising:

a front lower support including a front attachment section;

a rear lower support including a rear attachment section;

a front upper support including an upper attachment section, the front upper support being at least partially supported by the lower supports; a chest rest secured to one of the supports;

a seat that is coupled to one of the supports; and a connector that connects the front attachment section, the rear attachment section and the upper attachment section and allows for rotation of each of the attachment sections about a common axis.

4. The massage chair of claim 3 wherein the connector includes a locking mechanism that selectively inhibits relative motion between the front upper support and at least one of the lower supports.

5. The massage chair of claim 4 wherein the locking mechanism includes an upper support disk assembly that is secured to the front upper support, a lower support disk assembly that is secured to one of the lower supports, and a tightener that is used to urge the upper support disk assembly against the lower support disk assembly.

6. The massage chair of claim 5 wherein the upper support disk assembly includes a plurality of upper support disks and the lower support disk assembly includes a plurality of lower support disks.

7. The massage chair of claim 3 further comprising a flip latch that connects the seat to the rear lower support, wherein the seat is movable relative to the rear lower support between a transport position and an upright position, and wherein rotation of the flip latch in a first rotational direction relative to the front and rear lower supports allows the seat to move from the upright position toward the transport position.

8. The massage chair of claim 7 wherein rotation of the flip latch in a second rotational direction allows the seat to move from the transport position towards the upright position.

9. The massage chair of claim 3 wherein at least one of the supports has a substantially I-shaped cross-section.

10. The massage chair of claim 3 wherein at least a portion of one of the supports has a cross-section with a thickness that varies.

11. The massage chair of claim 3 further comprising a lateral support, wherein at least one of the lower supports includes a semi-circular shaped support channel that receives a portion of the lateral support.

12. The massage chair of claim 11 wherein the connector directly connects the front lower support, the rear lower support and the front upper support.

13. The massage chair of claim 3 further comprising a chest rest that is secured to one of the supports.

14. A massage chair comprising:

a front lower support;

a rear lower support;

a front upper support;

a chest rest secured to one of the supports; and a connector that directly connects the front lower support, the rear lower support and the front upper support, the connector directly securing the rear lower support to the front lower support, and the connector securing the front upper support to the rear lower support.

15. The massage chair of claim 14 wherein the connector includes a locking mechanism that selectively inhibits relative motion between the front upper support and at least one of the lower supports.

16. The massage chair of claim 15 wherein the locking mechanism includes an upper support disk assembly that is secured to the front upper support, a lower support disk assembly that is secured to one of the lower supports, and a tightener that is used to urge the upper support disk assembly against the lower support disk assembly.

17. The massage chair of claim 16 wherein the upper support disk assembly includes a plurality of upper support disks and the lower support disk assembly includes a plurality of lower support disks.

18. The massage chair of claim 14 further comprising a flip latch that connects the seat to the rear lower support, wherein the seat is movable relative to the rear lower support between a transport position and an upright position, and wherein rotation of the flip latch in a first rotational direction relative to the front and rear lower supports allows the seat to move from the upright position toward the transport position.

19. The massage chair of claim 18 wherein rotation of the flip latch in a second rotational direction allows the seat to move from the transport position towards the upright position.

20. The massage chair of claim 14 wherein at least one of the supports has a substantially I-shaped cross-section.

21. The massage chair of claim 14 wherein at least a portion of one of the supports has a cross-section with a thickness that varies.

22. The massage chair of claim 14 further comprising a lateral support, wherein at least one of the lower supports includes a semi-circular shaped support channel that receives a portion of the lateral support.

23. The massage chair of claim 14 wherein the connector allows for rotation of each of the supports about a common axis.

24. A massage chair comprising:

a front lower support;

a rear lower support that is secured to the front lower support;

a front upper support secured to the lower supports;

a chest rest that is secured to one of the supports;

a seat assembly that is secured to the rear lower support, the seat assembly being movable relative to the rear lower support between a transport position and an upright position; and a flip latch having a first end that is secured to the seat assembly, and a second end that is secured to the rear lower support, wherein rotation of the flip latch in a first rotational direction allows the seat assembly to move from the upright position towards the transport position.

25. The massage chair of claim 24 wherein the chest rest is secured to the front upper support.

26. A massage chair comprising:

a front upper support;

a chest rest secured to the upper support;

a tubular shaped lateral support;

a lower support that is supported by the lateral support, the lower support being secured to the front upper support, the lower support including a semi-circular shaped support channel that receives a portion of the lateral support; and a fastener for securing the lateral support to the lower support.

27. The massage chair of claim 26 wherein the fastener includes a first component and wherein the lower support includes a fastener aperture that receives a first component and inhibits the first component from rotating.

28. The massage chair of claim 27 wherein the fastener includes a second component and wherein the lateral support includes a lower aperture and an upper aperture, the lower aperture being sized and shaped to allow the entire second component to pass through and the upper aperture being sized and shaped to allow only a portion of the second component to pass through.

29. A massage chair comprising:

a front lower support;

a rear lower support that is coupled to the front lower support;

a front upper support that is coupled to one of the lower supports;

a seat assembly that is secured to one of the supports, the seat assembly being movable relative to the rear lower support between a transport position and an upright position; and a flip latch that is movably secured to the seat assembly, wherein rotation of the flip latch in a first rotational direction allows the seat assembly to move from an upright position towards a transport position without causing relative movement between any of the supports;

wherein at least one of the supports has a substantially I-shaped cross-section.

30. A massage chair comprising:

a lateral support;

a front lower support and a rear lower support that is coupled to the front lower support, at least one of the lower supports including a semi-circular shaped support channel that receives a portion of the lateral support;

a front upper support that is coupled to one of the lower supports;

a seat assembly that is secured to one of the supports, the seat assembly being movable relative to the rear lower support between a transport position and an upright position; and a flip latch that is movably secured to the seat assembly, wherein rotation of the flip latch in a first rotational direction allows the seat assembly to move from an upright position towards a transport position without causing relative movement between any of the supports.

31. A massage chair comprising:

a front lower support;

a rear lower support that is coupled to the front lower support;

a front upper support that is coupled to one of the lower supports, the front upper support being at least partially supported by the lower supports;

a seat assembly that is secured to one of the supports, the seat assembly being movable relative to the rear lower support between a transport position and an upright position;

a flip latch that is movably secured to the seat assembly, wherein rotation of the flip latch in a first rotational direction allows the seat assembly to move from an upright position towards a transport position without causing relative movement between any of the supports; and a connector that allows for rotation of each of the supports about a common axis.

32. A massage chair comprising:

a front lower support;

a rear lower support that is coupled to the front lower support;

a front upper support that is coupled to one of the lower supports;

a chest rest that is secured to one of the supports;

a seat assembly that is secured to one of the supports, the seat assembly being movable relative to the rear lower support between a transport position and an upright position; and a flip latch that is movably secured to the seat assembly, wherein rotation of the flip latch in a first rotational direction allows the seat assembly to move from an upright position towards a transport position without causing relative movement between any of the supports.

33. The massage chair of claim 32 wherein the chest rest is secured to the front upper support.

34. The massage chair of claim 32 wherein rotation of the flip latch in a second rotational direction allows the seat assembly to move from the transport position towards the upright position.

35. The massage chair of claim 32 further comprising a connector that directly connects the front lower support, the rear lower support and the front upper support.

36. The massage chair of claim 35 wherein the connector includes a locking mechanism that selectively inhibits relative motion between the front upper support and at least one of the lower supports.

37. The massage chair of claim 36 wherein the locking mechanism includes an upper support disk assembly that is secured to the front upper support, a lower support disk assembly that is secured to one of the lower supports, and a tightener that is used to urge the upper support disk assembly against the lower support disk assembly.

38. The massage chair of claim 37 wherein the upper support disk assembly includes a plurality of upper support disks and the lower support disk assembly includes a plurality of lower support disks.

39. The massage chair of claim 32 wherein at least one of the supports has a substantially I-shaped cross-section.

40. The massage chair of claim 32 wherein at least a portion of one of the supports has a cross-section with a thickness that varies.

41. The massage chair of claim 32 further comprising a lateral support, wherein at least one of the lower supports includes a semi-circular shaped support channel that receives a portion of the lateral support.

42. The massage chair of claim 32 further comprising a connector that allows for rotation of each of the supports about a common axis.

43. The massage chair of claim 42 wherein the connector includes a locking mechanism that selectively inhibits relative motion between the front upper support and at least one of the lower supports.

44. The massage chair of claim 43 wherein the locking mechanism includes an upper support disk assembly that is secured to the front upper support, a lower support disk assembly that is secured to one of the lower supports, and a tightener that is used to urge the upper support disk assembly against the lower support disk assembly.

45. The massage chair of claim 44 wherein the upper support disk assembly includes a plurality of upper support disks and the lower support disk assembly includes a plurality of lower support disks.

* * * * *

UNITED STATES PATENT AND TRADEMARK OFFICE

CERTIFICATE OF CORRECTION

PATENT NO. : 6,729,690 B2
DATED : May 4, 2004
INVENTOR(S) : Roleder et al.

It is certified that error appears in the above-identified patent and that said Letters Patent is hereby corrected as shown below:

Column 13,
Line 61, please move -- a chest rest secured to one of the supports; -- to the next line as a separate element of the claim.

Signed and Sealed this

Third Day of August, 2004

JON W. DUDAS
*Acting Director of the United States Patent and Trademark Office*